US007559587B2

(12) United States Patent
Mangone, Jr.

(10) Patent No.: US 7,559,587 B2
(45) Date of Patent: Jul. 14, 2009

(54) UNITIZED SECURITY SEAL

(76) Inventor: Peter G. Mangone, Jr., 2113 Montane Dr., Golden, CO (US) 80401

( * ) Notice: Subject to any disclaimer, the term of this patent is extended or adjusted under 35 U.S.C. 154(b) by 0 days.

(21) Appl. No.: 11/717,376

(22) Filed: Mar. 12, 2007

(65) Prior Publication Data

US 2008/0224485 A1 Sep. 18, 2008

(51) Int. Cl.
*B65D 27/30* (2006.01)
*B65D 33/34* (2006.01)

(52) U.S. Cl. ..... 292/307 R; 292/315; 292/316; 292/317; 292/320; 24/16 PB; 24/17 A; 24/17 PB

(58) Field of Classification Search ..... 292/307 R, 292/315–326; 24/16 PB, 17 A, 17 PB
See application file for complete search history.

(56) References Cited

U.S. PATENT DOCUMENTS 3,311,957 A * 4/1967 Dunn ..... 24/21
3,466,077 A 9/1969 Moberg
3,712,655 A 1/1973 Fuehrer
3,954,295 A 5/1976 Harley
4,059,300 A 11/1977 Moberg et al.
4,214,349 A 7/1980 Munch
4,229,031 A 10/1980 Guiler
4,240,183 A 12/1980 Sumimoto et al.
4,263,697 A 4/1981 Speedie
4,319,776 A 3/1982 Moberg
4,501,049 A * 2/1985 Adamson ..... 24/30.5 P
4,559,676 A 12/1985 Paradis
4,588,218 A 5/1986 Guiler et al.
4,609,218 A 9/1986 Chevillard et al.
4,854,014 A * 8/1989 Ueno ..... 24/16 PB
4,946,210 A 8/1990 Fuehrer
5,056,837 A 10/1991 Fuehrer
5,183,301 A * 2/1993 Lundberg, Jr. ..... 292/318
D355,054 S * 1/1995 Self ..... D29/129
5,568,952 A 10/1996 Ruegg
6,174,006 B1 * 1/2001 Burt ..... 292/307 A
6,347,734 B1 2/2002 Newman
6,449,808 B1 9/2002 Zappa et al.

FOREIGN PATENT DOCUMENTS

GB 2205279 A * 12/1988

* cited by examiner

*Primary Examiner*—Carlos Lugo
(74) *Attorney, Agent, or Firm*—Drinker Biddle & Reath LLP

(57) ABSTRACT

A unitized security seal having a shackle, an engagement housing with a passage for receiving the shackle, and at least two locking members spaced along the shackle, where each of the locking members has at least one undercut opening to the outer surface of the locking members, the undercuts of adjacent locking members being offset from each other, and at least one pin being located within the housing passage and oriented to engage the undercuts as the shackle is advanced through the passage to provide non-removable engagement of the shackle in the housing.

26 Claims, 9 Drawing Sheets

UNITIZED SECURITY SEAL

FIELD OF THE INVENTION

This invention relates to security seals and, more particularly, to unitized or integrally formed security seals that can be efficiently molded without compromising the efficacy or security attributes of the seals.

BACKGROUND OF THE INVENTION

There is a substantial need for security seals that may be manufactured efficiently and economically, and that are easy to use. Many such seals are currently available including seals formed of molded plastic in which a hollow body is formed as a single unit with internal flexible fingers for engaging a shackle.

Unfortunately, in order to efficiently mold plastic security seals of this type, the conventional wisdom is that the housing must be open at both ends to enable molding in a single step without the use of collapsible core molding tool members. However, an open housing typically makes it easy to pass a pick or other tool into the housing to disengage the locking fingers that retain the shackle, thereby circumventing the security function of the device.

Various approaches to overcoming these shortcomings of molded plastic security seals have been suggested over the years. None are without shortcomings. An early approach suggested in the prior art is illustrated in FIG. 1A. In this design, a closed locking housing 2 is formed with resilient locking members 3 that engage a pin 4. This design is extremely difficult (if not impossible) to manufacture and requires a complex collapsible core molding system which, if implemented on the very small scale typical of many conventional security seals, would be expected to be difficult to operate, to be liable to produce many mis-molded products, and to be subject to substantial manufacturing downtime.

Another example of a prior art design, as illustrated in FIG. 1B, includes an enclosed housing 5 with a separate locking member 6 mounted in the enclosed housing to block the bore of the locking member. Enclosed housing 6 in turn is designed to fit in an engagement receptacle 7 at the end of the shackle of the device. Unfortunately, this design is complicated and expensive to manufacture and assemble. Also, its security function can be compromised by prying member 6 away from housing 5 and receptacle 7 and releasing the shackle, and re-assembling later without any indication that the seal was disturbed.

Yet another prior art approach is illustrated in FIG. 1C. The security seal shown in this figure includes an open bore locking member 8 with one end of the bore closed off by a separate cover 9. Again, this approach is complex, expensive to make and assemble, and can be compromised and re-assembled.

Accordingly, it is an object of the present invention to provide a security seal with a design that can be molded as a unitized device without the use of complex collapsible core mold elements.

It is another object of the present invention to provide a security seal in which the security function is difficult to circumvent.

Another object of the present invention is to provide a security seal that achieves non-removable engagement so that it cannot be compromised without destroying the device.

It is a further object of the present invention to provide a security seal that is economical to make and easy to operate.

These and other objects and advantages may be achieved in accordance with the present invention as described below.

BRIEF SUMMARY OF THE INVENTION

The present invention is a unitized security seal which may be molded in a single stage without the use of collapsible mold core components. It includes a shackle and an engagement housing with a passage for receiving the shackle.

The shackle has at least two locking members spaced along it. Each of the locking members has at least one undercut opening extending to the outer surface of the locking member. The undercut openings of adjacent locking members must be offset from each other.

In preferred embodiments, the locking members have pairs of diametrically opposed undercuts and the undercuts include at least one ramp wall at an acute angle with respect to the central longitudinal axis of the shackle.

The unitized security seal also includes at least one pin located within the passage of the engagement housing. The pin is oriented to engage the undercuts in the locking members as the shackle moves through the passage. In preferred embodiments, the passage includes at least a pair of opposed pins that are oriented to engage diametrically opposed undercuts in the locking members. In another alternative embodiment of the invention, the unitized security seal has a strap positioned between the shackle and the engagement housing and at least two locking members on the shackle.

BRIEF DESCRIPTION OF THE DRAWINGS

The features of this invention that are believed to be novel are set forth with particularity in the appended claims. The invention, together with its objects and advantages, may be best understood by reference to the following description, taken in conjunction with the following drawings, in which like reference numerals identify like elements in the several figures, and in which:

DETAILED DESCRIPTION OF SELECTED EMBODIMENTS OF THE INVENTION

Figure 1A:
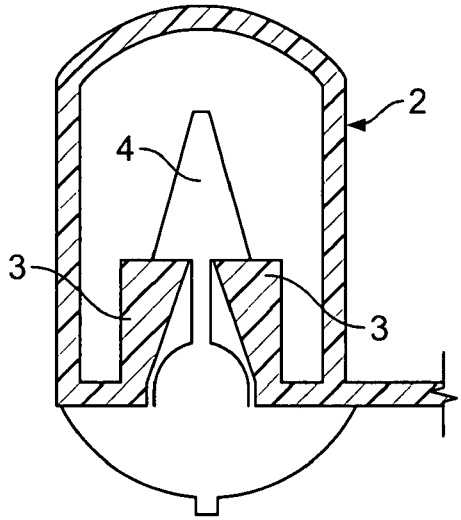
FIG. 1A (Prior Art)
FIGS. 1A-1C are views of prior art security seals.
Figure 1B:
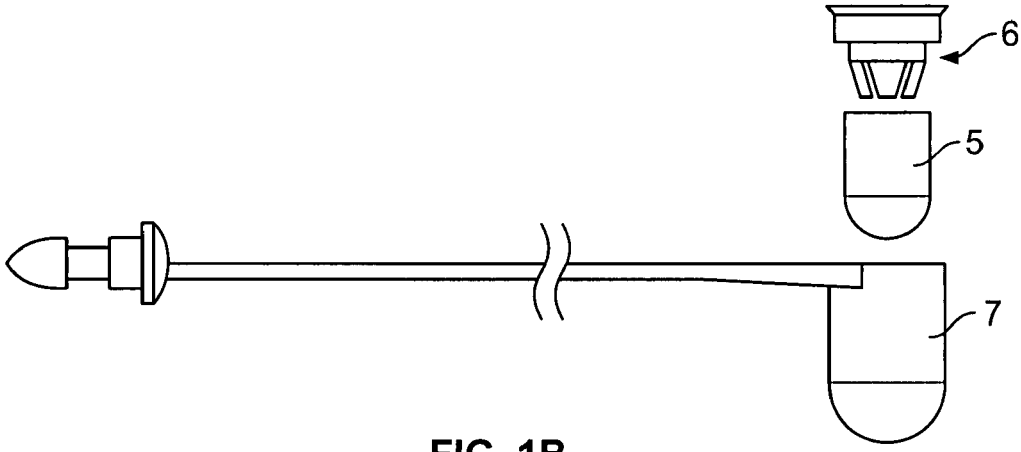
FIG. 1B (Prior Art)
Figure 1C:
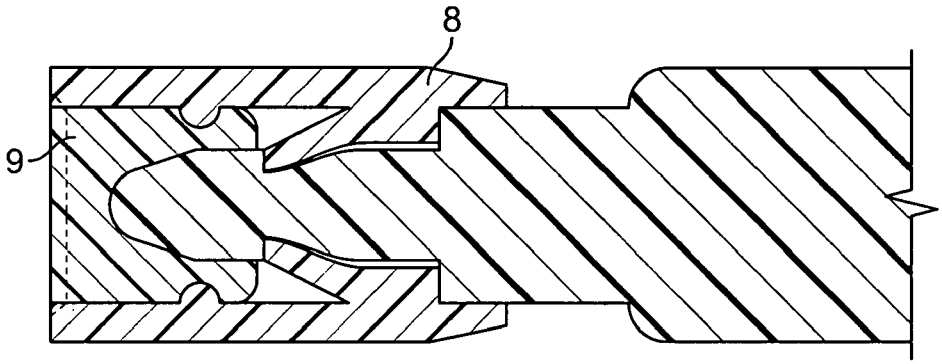
FIG. 1C (Prior Art)
Figure 2A:
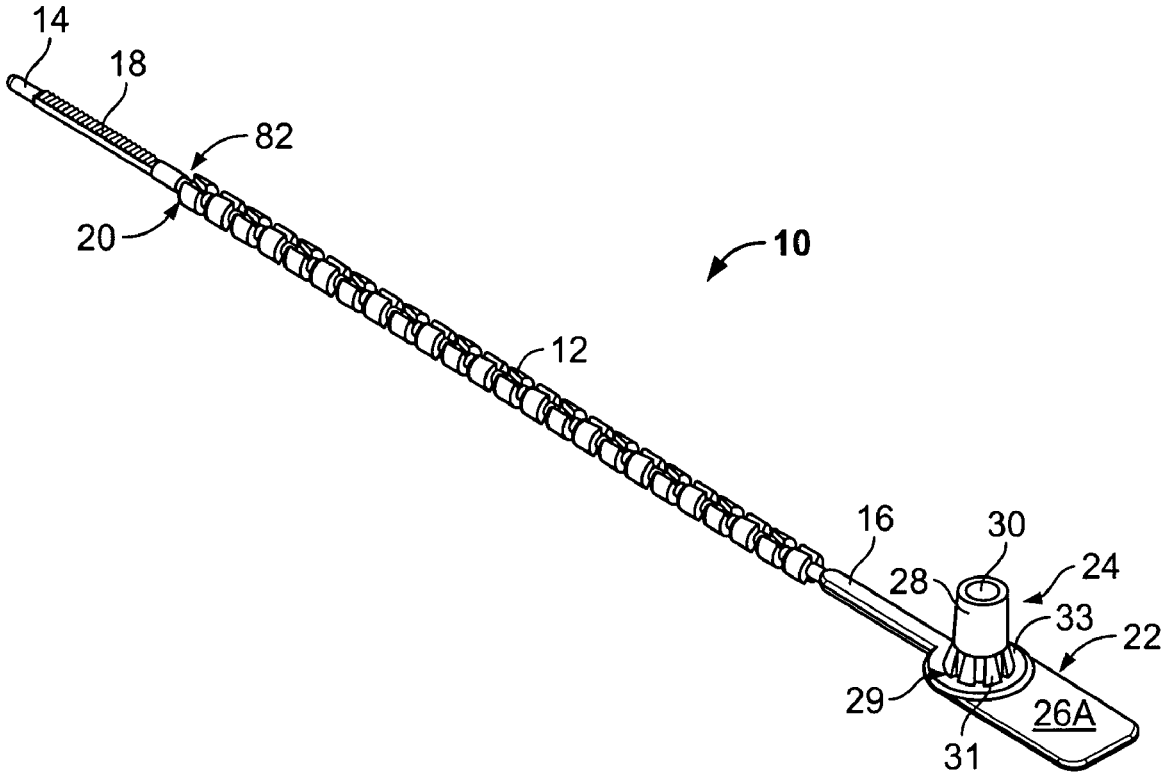
FIGS. 2A and 2B are perspective views of an elongated security seal in accordance with this present invention.
Figure 2B:
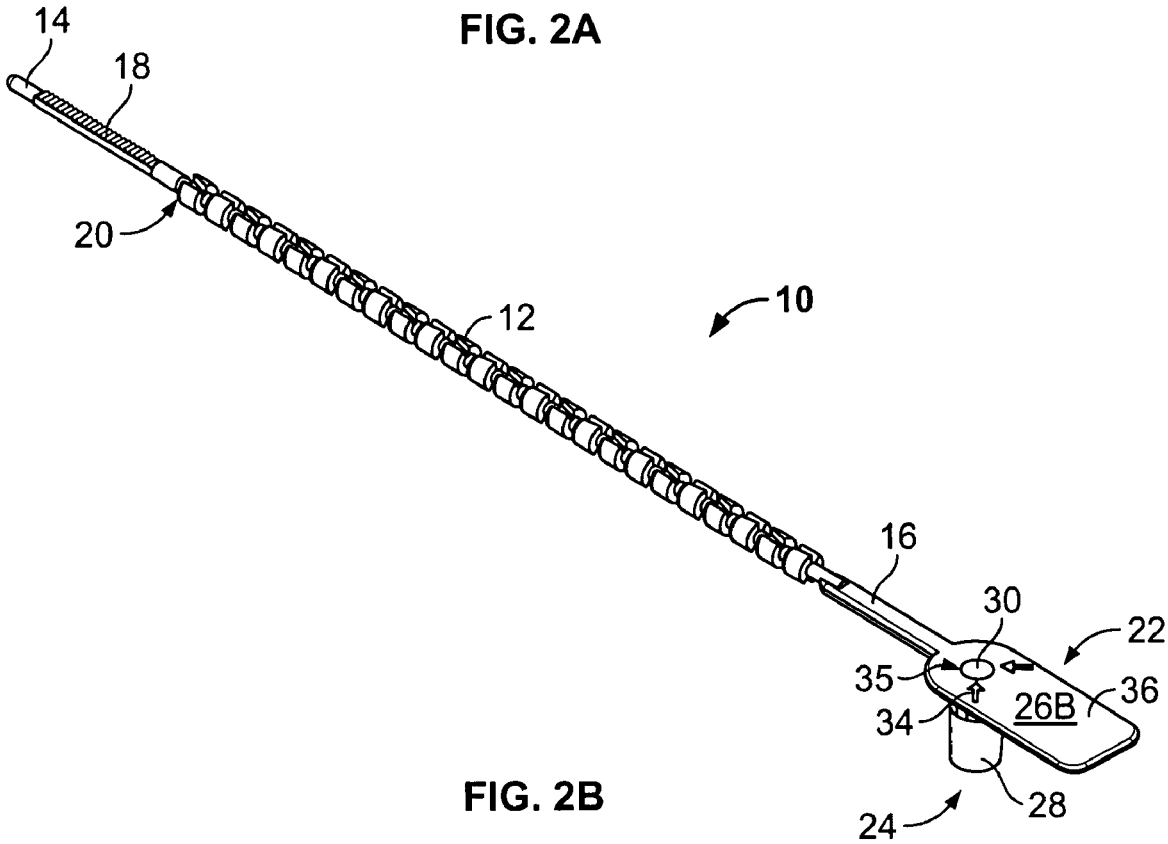

Turning now to FIGS. 2A and 2B, a unitized security seal 10 in accordance with the present invention is illustrated in two views rotated with respect to each other 180 degrees about the longitudinal axis of the device. Unitized security seal 10 may be molded of polypropylene, polyethylene, nylon or other appropriate resilient resin in a single stage and without the use of collapsible mold core components. The security seal includes a shackle 12 having a handle 14 at its distal end and a shackle base 16 at its proximal end. Handle 14 preferably includes serrations 18 to facilitate gripping. The shackle may be any desired length; for example, it may be 18 inches, 14 inches, 10 inches or shorter in length. The material and dimensions of the shackle (and the rest of the device) will be chosen to ensure that the shackle has sufficient flexibility to be bent around to the engagement housing of the device which is described below.

Shackle base 16 is attached to a security seal platform 22 that includes an upstanding engagement housing 24. Platform 22 is enlarged in the illustrated embodiment to present flat "flag" surfaces 26A and 26B appropriate for labeling the security seal as desired.

Engagement housing 24 includes a conical member 28 extending generally perpendicularly to the longitudinal axis of shackle 12 when it is in its unlocked and unbent configuration as shown in FIGS. 2A and 2B. Conical member 28 has a central bore 30 extending through it. The base 29 of the conical member is flared outwardly into a series of triangular brace members 31 to enhance the strength and ensure the integrity of the engagement housing. The brace members rest on a circular pedestal 33 which is formed in platform 22.

Arrows 34 are molded onto the back 36 of platform 22 to direct the user to insert handle 14 and shackle 12 into the entry 35 of bore 30 as required to achieve a proper irreversible locking of the shackle within the engagement housing. The irreversible locking feature of the shackle will be explained in more detail below.

Figure 3:
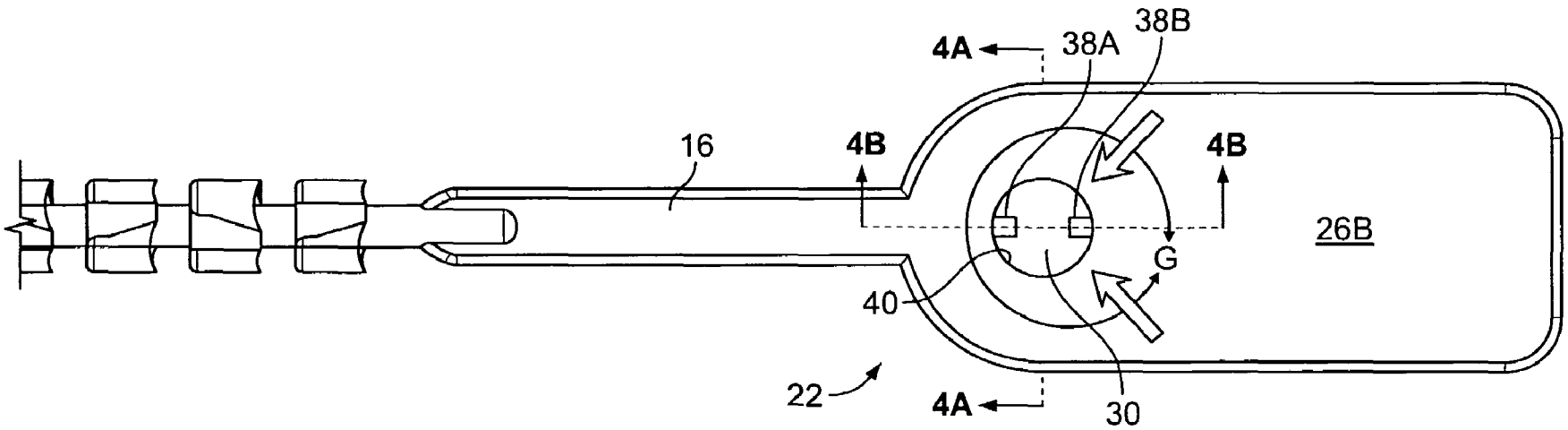
FIG. 3 is an elevation view of a proximal portion of the security seal of FIG. 1.
Figure 4A:
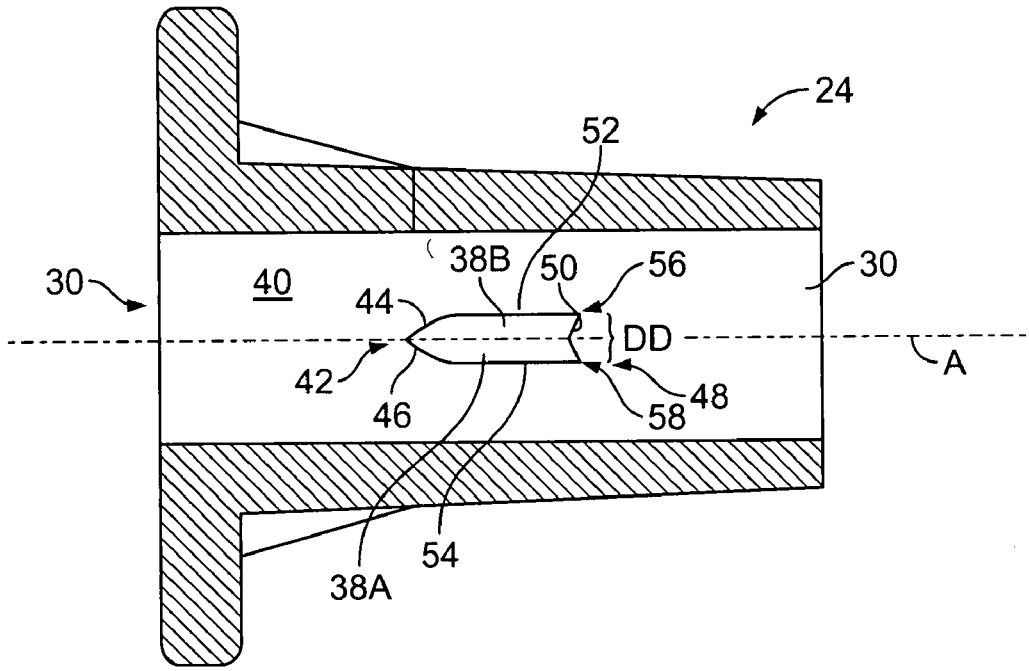
FIG. 4A is an enlarged cross-sectional view of the shackle-receiving engagement housing of the security seal of FIG. 1, taken along lines 4A-4A of FIG. 3.
Figure 4B:
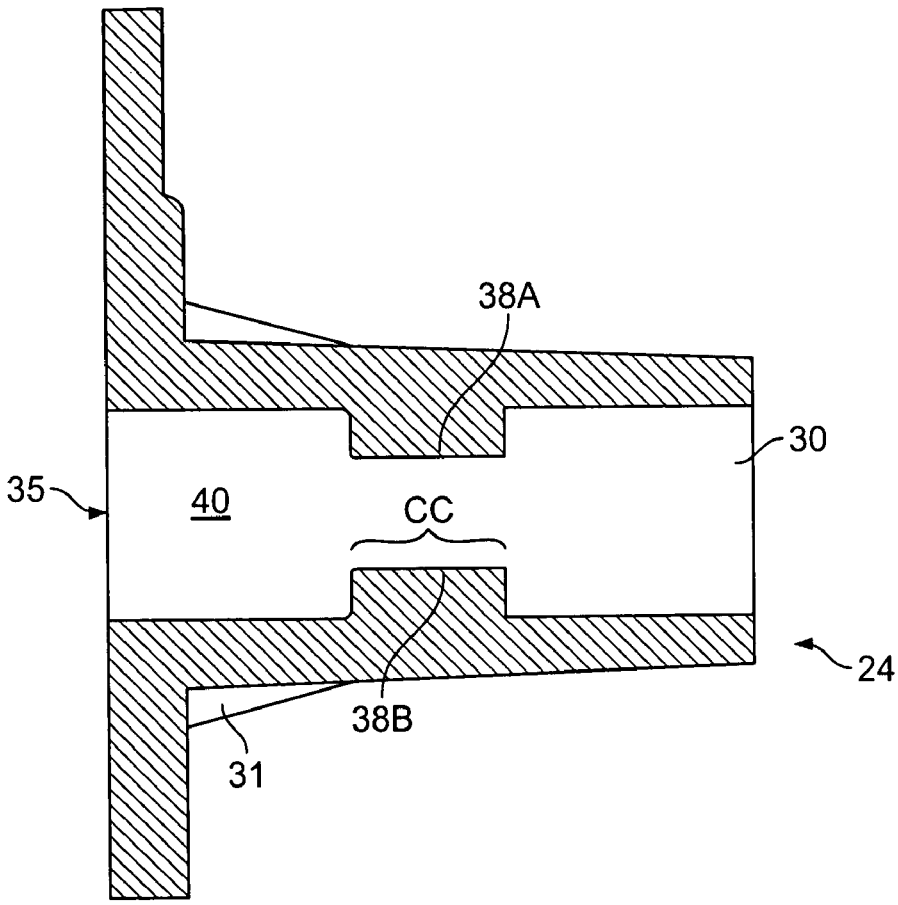
FIG. 4B is an enlarged cross-sectional view of the shackle-receiving engagement housing of the security seal of FIG. 1, taken along lines 4B-4B of FIG. 3 enlarged.

FIG. 3 is an enlarged elevation view of a portion of the proximal end of the security seal of FIGS. 2A and 2B in which diametrically opposed pins 38A and 38B may be seen within bore 30. The longitudinal axis A of the pins (FIG. 4A) is generally parallel to the axis of the bore. (While two pins are preferred as illustrated, a single pin could be used.) In the cross-sectional views of engagement housing 24 of FIGS. 4A and 4B, it is seen that pin 38B is molded onto the wall 40 of bore 30 and extends into the bore. Pins 38A and 38B are generally identical, and each includes a tapered nose portion 42 having generally flat angled sides 44 and 46. In the illustrated embodiment, these sides are at an angle of about 30° to the longitudinal axis A of the pin, although they may be of any suitable angle and preferably will be at an angle in the range of about 25 to 40 degrees to the axis. The pins have a length CC and a width DD.

Each of pins 38A and 38B also includes a pin base portion 48. The base portion has an indentation 50 that extends to the outer edges 52 and 54 of the pins to produce rearwardly directed projections 56 and 58 at either edge of the base portion of the pins.

Figure 5:
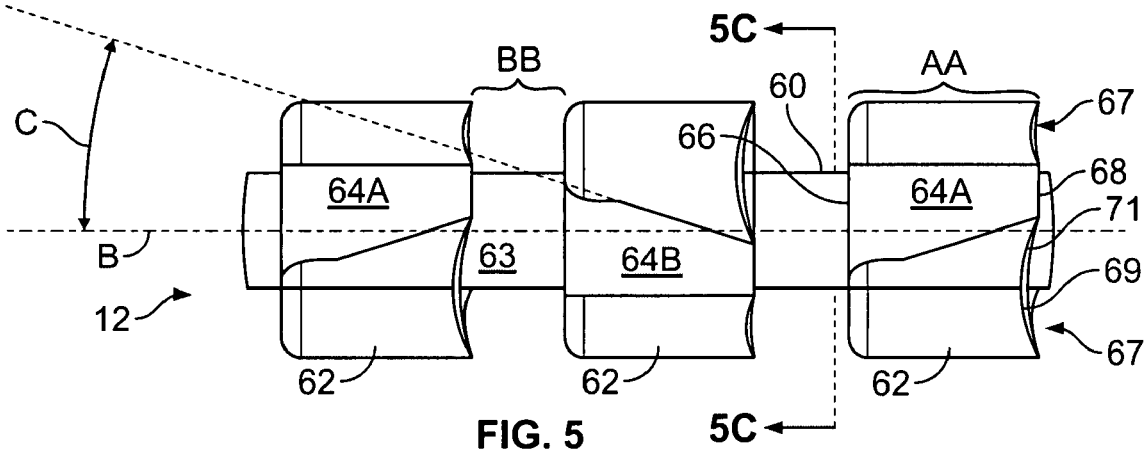
FIG. 5 is an enlarged elevation view of a portion of the shackle of the security seal of FIG. 1 showing three annular locking elements.

FIG. 5 is an enlarged elevation view of a portion of shackle 12 of the security seal of FIGS. 2A and 2B. As can be seen here, the shackle includes a central member 60 that carries a series of spaced integral annular locking members 62. Central member 60 in the illustrated embodiment has opposite generally flat faces 63 and 65 (FIG. 5C) to help ensure that the central member will break before sufficient rotational force can be transmitted to the shackle to overcome the engagement of the shackle in the engagement housing. Such a break in the shackle will signal that the security seal was breached and will prevent surreptitious reuse of the device. Center member 60 may, however, be of circular or other cross-sectional shape, as desired.

In its straight configuration as shown in FIG. 5 (before the shackle is bent around to be locked into the engagement housing), the central longitudinal axis of the central member is generally straight as represented by line "B". The locking members each have a length "AA" and they are spaced longitudinally from each other along the central member a distance "BB". Rotation of the shackle to move trapezoidal undercuts in locking members 62 into alignment with the pins will be resisted by the upwardly ramping sides 71 of scallops 67 that will be encountered by projections 56 and 58 at the base of the pins, as explained below.

Certain relationships between the length AA of the locking members, the spacing BB between the locking members and the length CC of the pins should be maintained in the security seal, as follows:

$$BB<CC$$

$$AA+BB>CC$$

Maintaining these relationships helps ensure that when the shackle is in position in the engagement housing the pin remains engaged with the trapezoidal undercuts and the shackle cannot be moved into a position in which the pin would be free within the space BB between adjacent locking members.

Locking members 62 each have trapezoidal-shaped undercuts 64A and 64B extending radially upward from flat faces 63 and 65 of the central member and running from the distal edge 66 to the proximal edge 68 of each annular locking member. The trapezoidal undercuts have an exit opening 73 coextensive with proximal edge 68 and an entry opening 75 coextensive with distal edge 66. Openings 73 and 75 are substantially parallel and opening 75 is larger than opening 73. Pins 38 A and 38B thus enter through opening 75 and are "funneled" through the trapezoidal undercuts and opening 73 as the shackle is moved into engagement with engagement member 24. Exit opening 73 has a width EE. It is preferred that the width DD of pins 38A and 38B be substantially equal to the width EE of the exit opening to minimize the likelihood that the engagement member could be worked loose from the pins. "Substantially equal" in this context means that the width of the exit opening is of a size with respect to the width of the pin that will permit the pin to pass through the exit opening while engaging both sides of the opening and without preventing the shackle from being advanced through the engagement housing.

Figure 5A:
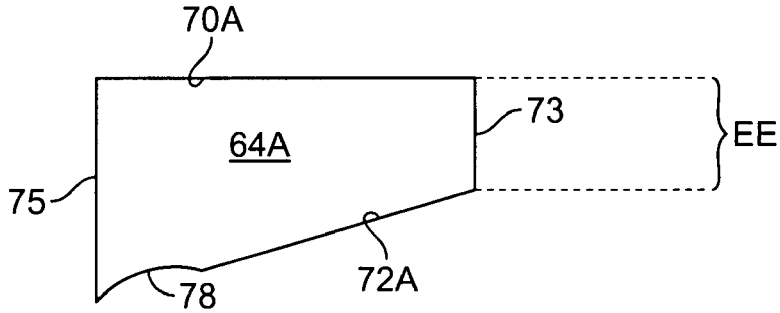
FIGS. 5A and 5B are diagrammatic representations of trapezoidal undercuts in annular locking members of the security seal.
Figure 5B:
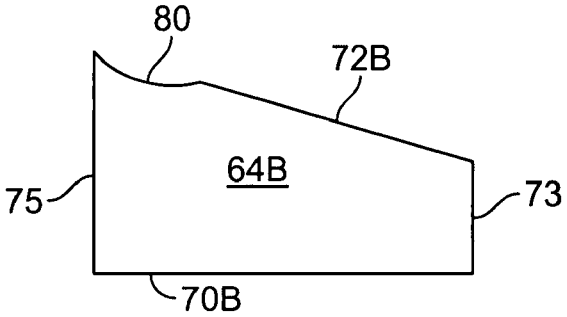
Figure 5C:
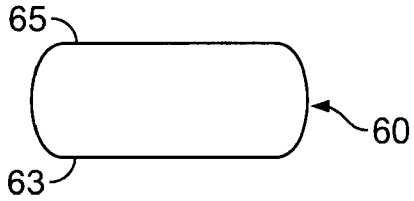
FIG. 5C is a cross-sectional view of the central member of the shackle of the FIG. 1 security seal taken along lines 5C-5C of FIG. 5.

The trapezoidal-shaped undercuts 64A and 64B are illustrated diagrammatically in FIGS. 5A and 5B. Thus, as seen in these figures, undercuts 64A have an inner wall 70A that is generally parallel to longitudinal axis B of the unbent shackle central member 60 and an outer ramp wall 72A that is angled to longitudinal axis B. In the illustrated embodiment, the angle "C" of the ramp wall is about 15° to longitudinal axis B. While an angle of approximately this size is most preferred, the angle may preferably range from about 10 to 20 degrees. Undercut 64B is generally a mirror image of undercut 64A so that the inner wall 70B of undercut 64B is generally parallel to longitudinal axis B and outer ramp wall 72B is at an angle generally corresponding to that of inner wall 72A. The proximal edges of the annular locking members each have scallops 67 as shown in FIG. 5. Ramp walls 72A and 72B may also include optional bosses 78 and 80 that project into the trapezoidal undercut area adjacent to the entry openings to help guide the pins into the undercut area and to resist removal of the shackle from the engagement member by backing the pin out of the trapezoidal undercut.

The inner and ramp walls of the trapezoidal undercuts meet scallops 67 at or near their respective high points. Therefore, as explained in more detail below, when the projections at the base of pins 38A or 38B abut the bottom 69 of the scallops, rotation of the shackle to position the pins into alignment with the trapezoidal undercuts is resisted by the upwardly ramping sides 71 of the scallops.

Figure 6A:
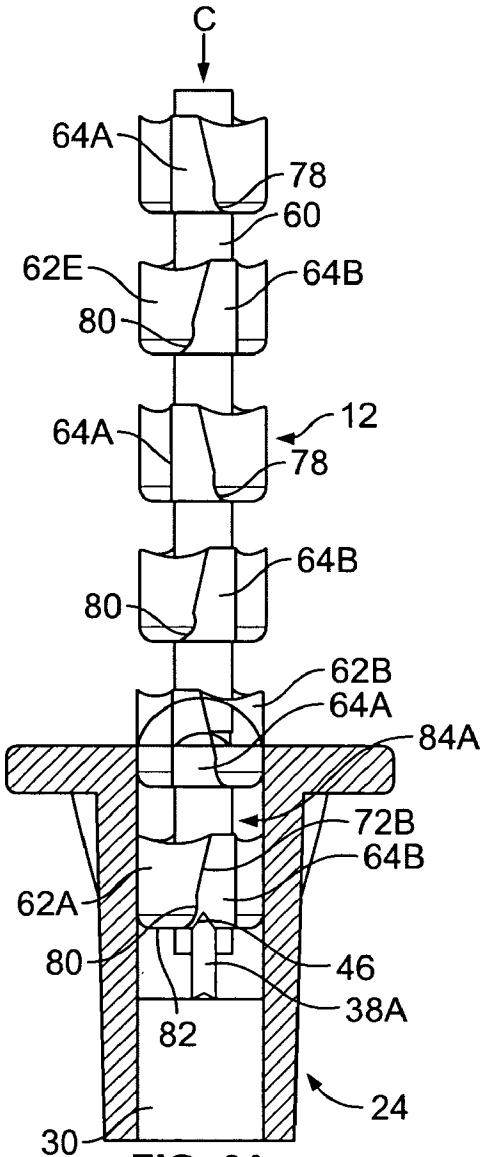
FIGS. 6A-6F are partial views of the security seal of FIG. 1 showing its shackle advancing within the shackle-receiving engagement housing of the security seal to lock the shackle to the engagement housing and resist pull-out.
Figure 6B:
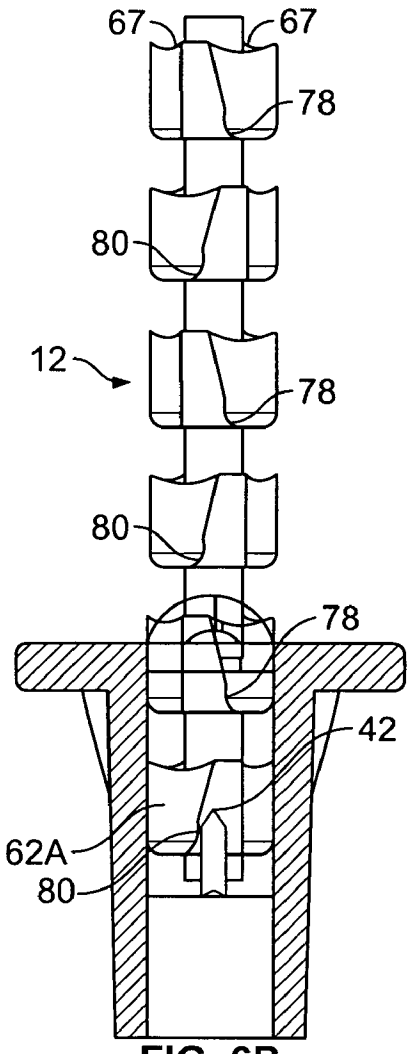
Figure 6C:
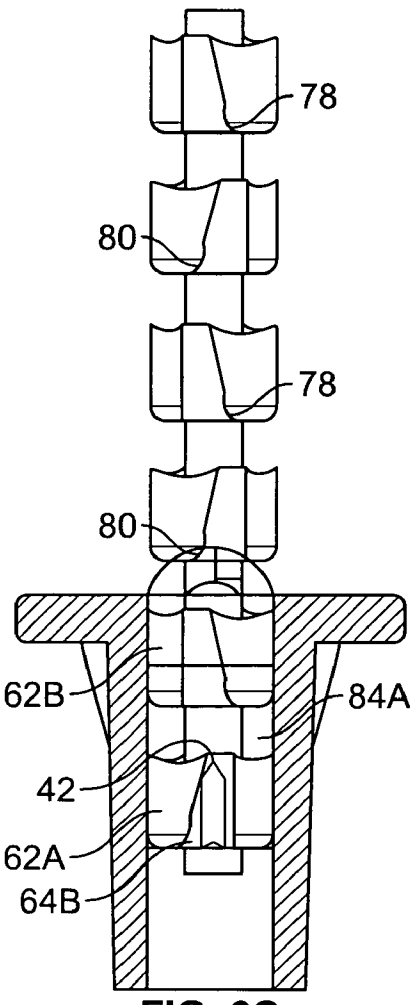

We turn now to FIGS. 6A-6F to illustrate the irreversible locking function achieved when shackle 12 is inserted in direction "C" into entry 35 of engagement housing 24. Thus a portion of the distal end 82 of the shackle is shown in FIG. 6A with the surface 72B of trapezoidal undercut 64B of the first annular locking member 62A engaging side 46 of pin 38A. As the distal end of the shackle member is moved further into bore 30 of the engagement housing, the pin rides along ramp wall 70A and the advancing shackle member resiles or rotates counterclockwise under the urging of the advancing ramp wall against the pin (FIG. 6B). Pin 38A may flex slightly under the force applied by the ramp wall but will resile back to its original position as the shackle moves past the pin. When the shackle reaches the position shown in FIG. 6C, nose portion 42 of pin 38 has begun to emerge from trapezoidal undercut 64B of the annular locking member 62A as it enters the space 84A between the first annular locking member 62A and the second annular locking member 62B.

Figure 6F:
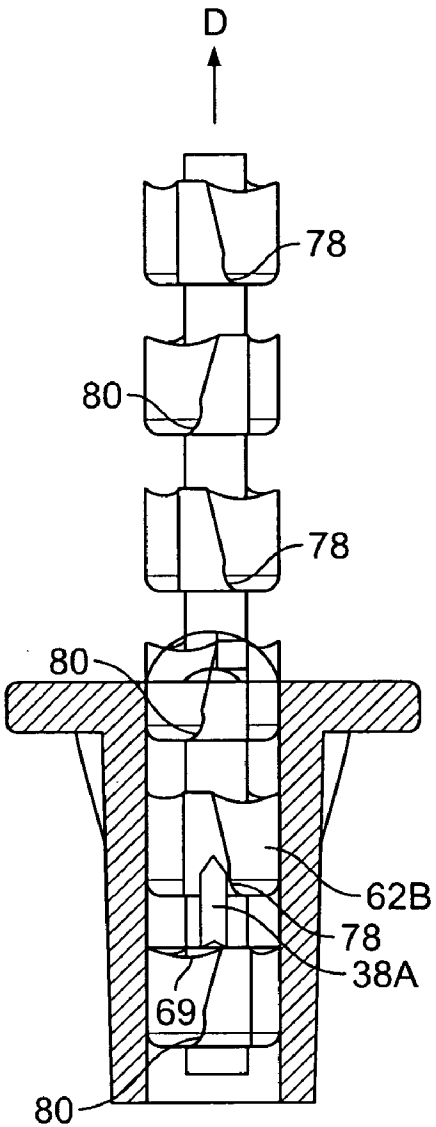
Figure 6E:
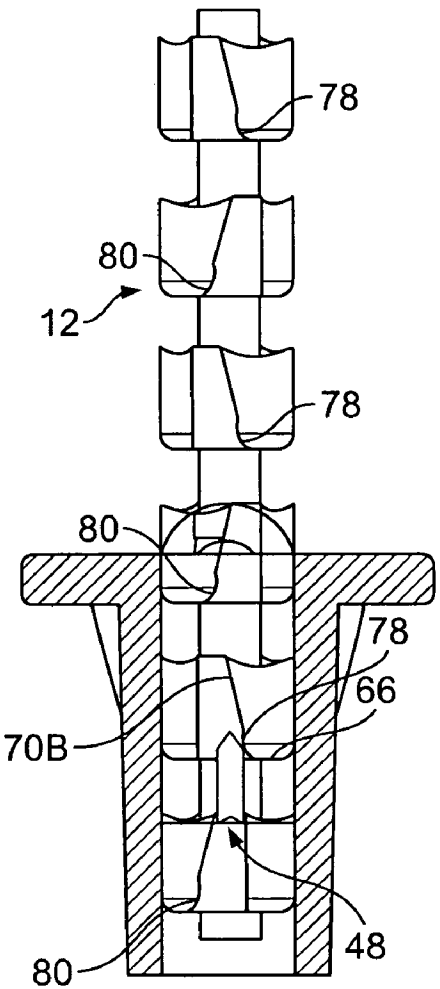
Figure 6D:
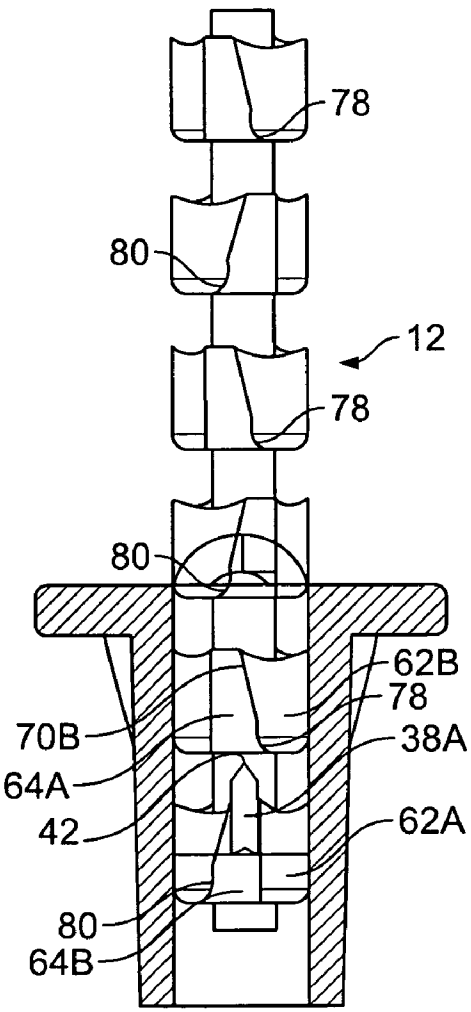
Figure 7:
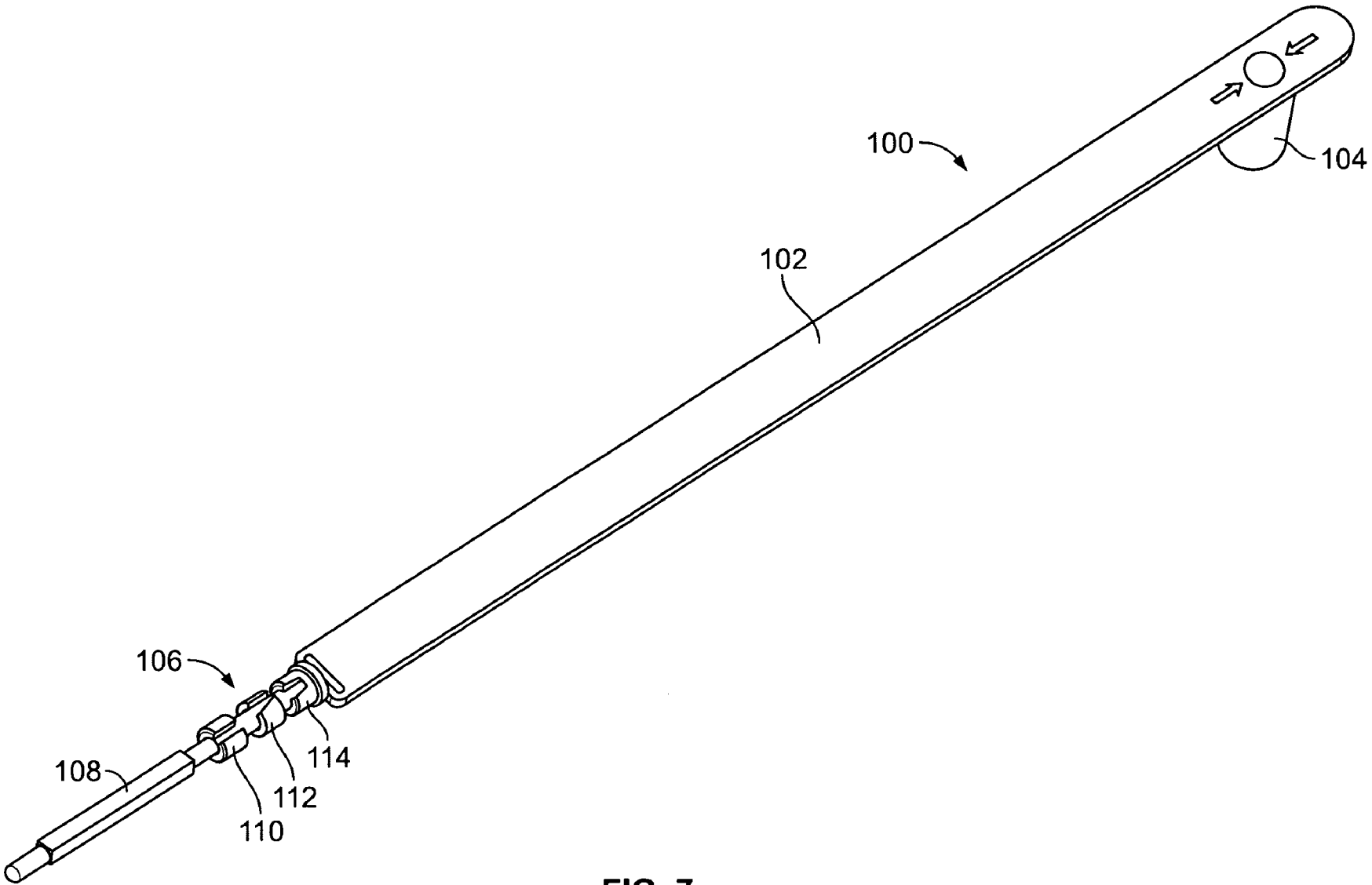
FIG. 7 is a perspective view of an alternative embodiment of the invention having a flexible elongated strap between the shackle and the shackle-receiving member.

In FIG. 6E shackle 12 is shown advanced to the point where trapezoidal undercut 64A of annular locking ring 62B meets nose portion 42 of pin 38A, as trapezoidal undercut 64B of the most distal locking ring 62A of the shackle disengages from the pin. In FIG. 6E, the continuing advancement of the shackle causes contact surface 70B to move along the pin causing the shackle to resile back and to rotate clockwise under the urging of the pin against ramp wall 70B. This continues until the base portion 48 of the pin clears the distal wall 68 of the first locking ring, as shown in FIG. 6F. In this position, the projections 56 and 58 (FIG. 4A) at the base of pins 38A or 38B abut the bottom 69 of the scallops. As a result, any attempt to remove the shackle from engagement housing 24 (by moving it in direction "D") will be blocked by these intersecting elements. Additionally, any attempt to pass a pick or other member longitudinally into bore 30 to get at the pin and rotate the shackle in order to back it out of the locking housing will be blocked by the offset of oppositely oriented trapezoidal undercuts 64A and 64B. Furthermore, the same result obtains for attempts made at either the proximal or the distal end of the bore. As the shackle advances further into the locking housing, it will rotate alternatively clockwise and counterclockwise as described above. Attempts to remove the shackle will become more and more difficult after more locking members have been moved past the pins since the presence of more locking members will make it more cumbersome to defeat the locking mechanism for each successive locking member within and proximal to bore hole 30. This resistance to removal of the shackle is enhanced by bosses 78 and 80 which help impede distal movement of the ramp walls past the pins.

FIGS. 7-10A illustrate an alternative embodiment of the invention in which a security seal 100 is provided with a generally flat strap 102 located between an engagement housing 104 (configured as described above with respect to features 22 and 24 of security seal 10) and a shortened shackle 106 having a handle 108 at its distal end. In the illustrated embodiment, shackle 106 includes three annular locking members 110 and 112 and 114.

Figure 8:
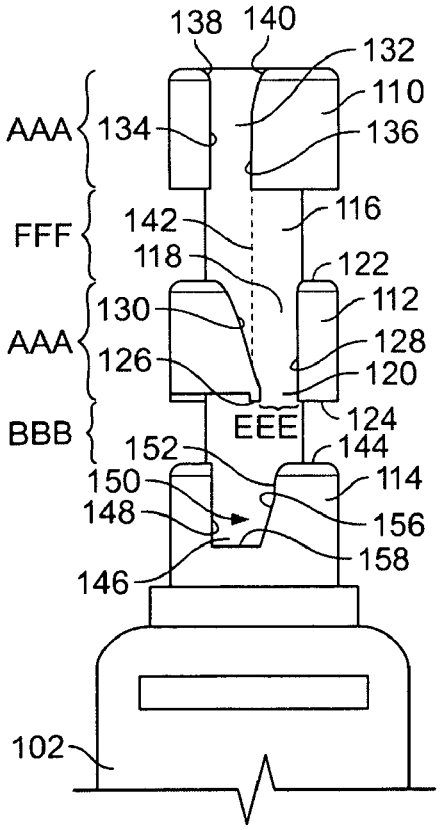
FIG. 8 is an enlarged partial elevation view of the distal end of the security seal of FIG. 7 with the handle of the seal removed.

The distal end of shackle 106 (with the handle of the seal removed for illustration purposes) is illustrated in FIG. 8. As can be seen in this figure, the shackle includes a central member 116 that is generally circular in cross-section. As is apparent in this figure, interlocking members 110, 112 and 114 each have different configurations but the same lengths "AAA". Beginning with intermediate annular member 112, it is seen that this locking member has a trapezoidal-shaped undercut 118 extending radially upward from the surface 120 of central member 116. This trapezoidal undercut extends from the distal face 122 to the proximal face 124 of annular locking member 112. Proximal face 124 is generally flat, but includes a proximally directed spur 126. The trapezoidal undercut includes an inner wall 128 generally parallel to the longitudinal axis of the shackle and an outer ramp wall 130. The angle of the ramp wall with respect to the axis of the shackle is about 15°, and preferably will range from about 10 to 20 degrees.

The most distal annular locking member 110 ("the entry locking member") serves primarily to block entry to bore 160 of engagement housing 104 when the shackle is fully engaged. Locking member includes a generally straight undercut 132 having an outer sidewall 134 and an inner sidewall 136. The most proximal ends of the walls of the generally straight undercut are radiused at 138 and 140 to facilitate entry of pins 162A or 162B into the undercut, as will be explained below. Also, undercut 132 is offset with respect to undercut 118, to prevent a clear line of sight between the undercuts and hence entry of a pick or other tool intended to overcome the security of a shackle engaged in the engagement housing. This is illustrated, for example, by broken line 142 which extends proximally from inner sidewall 136 in annular locking member 110 and intersects outer ramp wall 130 of annular locking member 112.

Finally, shackle 106 includes a proximal annular locking member 114 attached to strap 102. Annular locking member 114 has a distal face 144 and a trapezoidal undercut 146 extending radially upward from surface 120 of central member 116. Undercut 146 includes a generally flat outer wall 148 and an inner wall 150 having a radiused entry point 152, and an inwardly ramped base wall 156. Undercut 146 is closed at its base 158. The spacing between locking members 110 and 112 is designated FFF and the spacing between locking members 112 and 114 is designated BBB.

Figure 9:
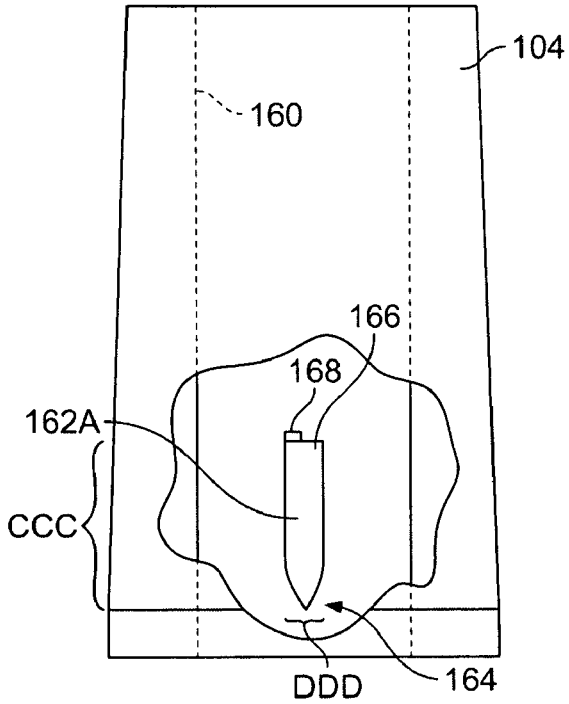
FIG. 9 is a cutaway elevation view of the shackle-receiving engagement housing of the security seal of FIG. 7.

In FIG. 9, engagement housing 104 is shown with its central bore 160 in broken lines. A portion of the engagement housing has been cut away in this figure to reveal pin 162A in the housing (pin 162B has been removed to improve the clarity of the view). Pin 162A includes a tapered nose 164 generally corresponding to tapered nose 42 of pins 38A and 38B. Base 166 of pin 162A includes a rearwardly projecting pin spur 168 generally corresponding to spur 126 of annular locking member 112. The pin has a length CCC and a width DDD. As in the case of the embodiment of the invention of FIGS. 1-7, the length CCC of the pin must be greater than the space BBB between annular members 112 and 114 and it is preferred that the width DDD of the pin is substantially equal to the exit opening EEE of trapezoidal undercut 118 to minimize the likelihood that engagement member 104 could be worked loose. However, it should be noted that in the illustrated embodiment spacing FFF between annular members 110 and 112 is greater than spacing BBB between annular members 112 and 114 because the critical locking function is achieved in this embodiment through the offset of the trapezoidal openings of annular members 112 and 114 and by the engagement of spurs 126 and 168.

Figure 10:
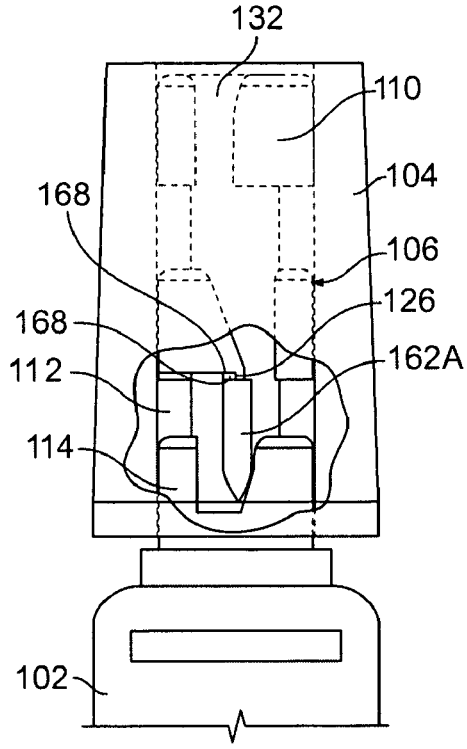
FIG. 10 is an elevation view of the shackle of the security seal of FIG. 7 in locking engagement with the shackle-receiving engagement housing and FIG. 10A is a like view of the opposite side thereof.
Figure 10A:
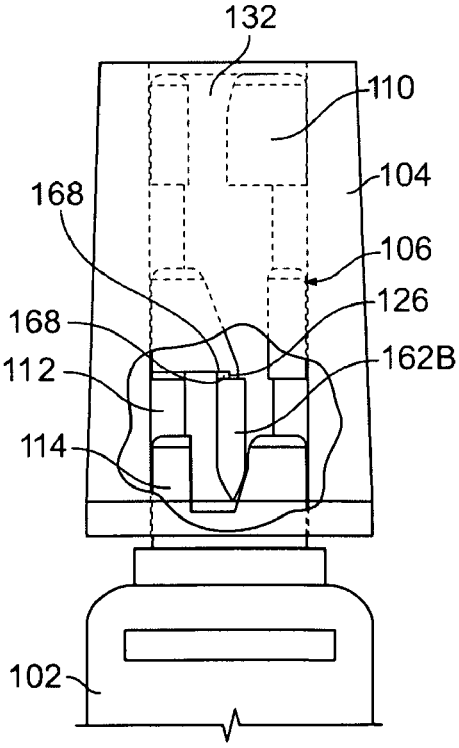

Turning now to FIGS. 10 and 10A, the distal end of shackle 106 is shown locked into engagement housing 104. A portion of the shackle locked within the engagement housing is shown in this figure in broken lines since it lies below the surface of the housing. As is apparent from FIG. 10, when the shackle was first inserted into the housing, pin 162A was aligned with straight undercut 132 (with pin 162B aligned with a like undercut on the opposite side of the shackle as shown in FIG. 10A) and the undercut moved past the pin as the shackle was advanced into the engagement housing. As the undercut moved past the pin to locate the pin in the space FFF between annular locking member 110 and annular locking member 112, nose 164 of the pin met outer ramp wall 130 of undercut 118 causing the shackle to rotate as the ramp wall moved along the pin until the pin reached the proximal end of undercut 118. At this point, the advancing shackle caused pin 162A to emerge from undercut 118 and move through the space BBB between annular locking member 112 and annular locking member 114. The continuing movement of the shackle caused nose 164 of the pin to enter undercut 146 of proximal annular locking member 114 until ramped base wall 156 engaged the pin causing the shackle to resile or rotate in the opposite direction as the shackle moved further into the engagement member. As the proximal end 124 of annular locking member 112 cleared the pin, and pin base spur 168 also cleared spur 126 of annular member 112, with the rotation causing spurs 126 and 168 to interlock as shown, irreversibly fixing the shackle within the engagement housing. Thus any attempt to twist the engagement housing in order work the pin back through the undercuts will be prevented by engagement between spurs 126 and 168, any attempt to pull the shackle out of the engagement housing by brute force will be prevented by the engagement between the pin base 166 and the proximal end of locking member 112, and any effort to work a pick or any tool into the engagement housing will be prevented by entry locking member 110 and the offsets (and therefore absence of a clear line of sight) between undercuts 118, 132 and 146.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A unitized security seal comprising:

a shackle;

an engagement housing with a passage for receiving the shackle;

at least distal, intermediate and proximal members spaced along the longitudinal axis of the shackle, each of the members having at least one undercut extending longitudinally through the member and opening to the member outer surface, the undercuts of the members being offset from each other; and at least one pin located within the passage oriented to be received and guided through the undercut of the distal member, pass through the undercut of the intermediate member and rest adjacent the undercut of the proximal member, the proximal member preventing further insertion of the shackle and the intermediate member engaging the pin to prevent disengagement of the shackle from the housing.

2. The unitized security seal of claim 1 in which the unitized security seal is integrally molded from a resin chosen from the group consisting of polypropylene, polyethylene, or nylon.

3. The unitized security seal of claim 1 in which the shackle has a central member with at least two opposite generally flat faces.

4. The unitized security seal of claim 1 in which the shackle includes a handle at its distal end and the handle includes serrations to facilitate gripping.

5. The unitized security seal of claim 1 including at least one labeling surface.

6. The unitized security seal of claim 1 in which the pin includes a base and a first spur extending distally from the base and the intermediate member includes a second spur, the first and second spurs being positioned to interlock to resist rotation of the shackle.

7. The unitized security seal of claim 1 in which the pin has a predetermined length and the spacing between the members is less than the predetermined length of the pin.

8. The unitized security seal of claim 1 in which the length of the pin, the length of the members, and the spacings between the members are predetermined and the sum of the length of a member and the spacing between two members is greater than the length of the pin.

9. A unitized security seal comprising:

a shackle;

an engagement housing with a passage for receiving the shackle;

at least distal, intermediate and proximal members spaced along the shackle, each of the members having at least one undercut opening to the member outer surface;

at least one pin located within the engagement housing passage oriented to be received and guided through the undercut of the distal member, pass through the undercut of the intermediate member and rest adjacent the undercut of the proximal member, the proximal member preventing further insertion of the shackle and the intermediate member engaging the pin to prevent disengagement of the shackle from the housing; and the undercuts of the members being offset from each other, including an entry opening and an exit opening, the entry opening being larger than the exit opening, with the undercuts including an angled ramp wall intersecting the entry and exit openings, the ramp wall being positioned to engage the pin as the shackle is advanced through the engagement housing, whereby the engagement of the ramp wall with the pin causes the shackle to rotate as it is advanced.

10. The unitized security seal of claim 9 in which the ramp wall is at an angle of about 10° to 20° to the longitudinal axis of the shackle.

11. The unitized security seal of claim 9 in which the ramp wall is at an angle of about 15° to the longitudinal axis of the shackle.

12. The unitized security seal of claim 9 in which the pin has a predetermined width and the width of the pin is substantially equal to the width of the exit opening.

13. The unitized security seal of claim 9 in which the ramp wall has a boss adjacent to the entry opening.

14. The unitized security seal of claim 9 in which the pin has a tapered nose portion.

15. A unitized security seal comprising:

a shackle;

an engagement housing with a passage for receiving the shackle;

at least distal, intermediate and proximal members spaced along the shackle, each of the members having at least a pair of diametrically opposed undercuts opening to the member outer surface, the undercuts of the members being offset from each other; and a pair of opposed pins located within the passage to be received and guided through the undercut of the distal member, pass through the undercut of the intermediate member and rest adjacent the undercut of the proximal member, the proximal member preventing further insertion of the shackle and the intermediate member engaging the pins to prevent disengagement of the shackle from the housing.

16. A unitized security seal comprising:

a shackle;

an engagement housing with a passage for receiving the shackle;

at least distal, intermediate and proximal members spaced along the shackle, each of the members having at least a pair of diametrically opposed undercuts opening to the member outer surface including generally parallel entry and exit openings at opposite ends of the undercuts, the entry openings being larger than the exit openings, and an angled ramp wall intersecting the entry openings and exit openings, the undercuts of adjacent members being offset from each other; and a pair of opposed pins located within the passage oriented to be received and guided through the opposed undercuts of the distal member, pass through the undercuts of the immediate member and rest adjacent the undercut of the proximal member, the proximal member preventing further insertion of the shackle and the intermediate member engaging the pins to prevent disengagement of the shackle from the housing.

17. The unitized security seal of claim 16 in which the pin includes a base and a first spur extending distally from the base and the intermediate member includes a second spur, the first and second spurs being positioned to interlock to resist rotation of the shackle.

18. The unitized security seal of claim 16 in which the pin has a predetermined length and the spacing between the members is less than the predetermined length of the pin.

19. A unitized security seal comprising:

a shackle;

an engagement housing with a passage for receiving the shackle;

a strap positioned between the shackle and the engagement housing;

at least distal, intermediate and proximal members spaced along the shackle, each of the members having a pair of diametrically opposed undercuts opening to the outer surface of the members;

the undercuts of adjacent members being offset from each other; and a pair of opposed pins located within the passage to be received and guided through the undercuts of the distal member, pass through the undercuts of the intermediate member and rest adjacent the undercuts of the proximal member, the proximal member preventing further insertion of the shackle and the intermediate member engaging the pins to prevent disengagement of the shackle from the housing.

20. The unitized security seal of claim 19 in which at least the undercut opening of the intermediate member is trapezoidal in shape and includes an entry opening and an exit opening, the entry opening being larger than the exit opening, with the undercut including an angled ramp wall intersecting the entry openings and exit openings, the ramp wall being positioned to engage the pin as the shackle is advanced through the engagement housing, whereby the engagement of the wall with the pin causes the shackle to rotate as it is advanced.

21. The unitized security seal of claim 20 in which the ramp wall is at an angle of about 10° to 20° to the longitudinal axis of the shackle.

22. The unitized security seal of claim 20 in which the pin has a predetermined width and the width of the pin is substantially equal to the width of the exit opening.

23. The unitized security seal of claim 19 in which each of the locking members has at least a pair of diametrically opposed undercuts and wherein the at least one pin comprises a pair of opposed pins that are located within the passage of the engagement housing with the pair of opposed pins being oriented to engage the diametrically opposed undercuts in the locking members.

24. The unitized security seal of claim 19 in which each pin has a predetermined length and the spacing between the proximal and intermediate members is less than the predetermined length of the pins.

25. The unitized security seal of claim 19 including an entry member positioned proximally to the intermediate member.

26. A unitized security seal comprising:

a shackle;

an engagement housing with a passage for receiving the shackle;

a strap positioned between the shackle and the engagement housing;

at least distal, intermediate and proximal members spaced along the shackle, each of the members having an undercut opening to the outer surface of the members;

the undercuts of adjacent members being offset from each other; and a pin located within the passage be received and guided through the undercut of the distal member, pass through the undercut of the intermediate member and rest adjacent the undercut of the proximal member, the proximal member preventing further insertion of the shackle and the intermediate member engaging the pin to prevent disengagement of the shackle from the housing, the pin including a base and a first spur extending distally from the base and at least the intermediate member including a second spur, the first and second spurs being positioned to interlock to resist rotation of the shackle.

* * * * *